US011787191B2

(12) United States Patent
Ninagawa

(10) Patent No.: US 11,787,191 B2
(45) Date of Patent: Oct. 17, 2023

(54) LIQUID CONTAINER AND METHOD OF MANUFACTURING THE SAME

(71) Applicant: CANON KABUSHIKI KAISHA, Tokyo (JP)

(72) Inventor: Takeshi Ninagawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/154,690

(22) Filed: Jan. 13, 2023

(65) Prior Publication Data

US 2023/0150267 A1 May 18, 2023

Related U.S. Application Data

(63) Continuation of application No. 17/171,904, filed on Feb. 9, 2021, now Pat. No. 11,554,589.

(30) Foreign Application Priority Data

Feb. 19, 2020 (JP) ..... 2020-026485
Nov. 26, 2020 (JP) ..... 2020-196187

(51) Int. Cl.
*B41J 2/175* (2006.01)

(52) U.S. Cl.
CPC ..... *B41J 2/17513* (2013.01); *B41J 2/17523* (2013.01)

(58) Field of Classification Search
CPC ..... B41J 2/17513; B41J 2/17523; B41J 2002/17516
USPC ..... 347/86
See application file for complete search history.

*Primary Examiner* — Matthew Luu
*Assistant Examiner* — Alexander D Shenderov
(74) *Attorney, Agent, or Firm* — Canon U.S.A., Inc. I.P. Division

(57) ABSTRACT

A liquid container to be mounted in a liquid ejection apparatus contains liquid to be ejected from the liquid ejection apparatus. The liquid container comprises a liquid container bag containing liquid, at least one tube arranged in the inner space of the liquid container bag and having the first end open to the inner space, a connection member fitted to the aperture of the liquid container bag and connected to the second end of the tube and a holding member supported by the connection member and arranged in the inner space to hold the tube, the holding member having at least a groove for receiving the tube to be fitted thereinto at a position thereof other than the second end thereof. The holding member can integrally be molded.

7 Claims, 9 Drawing Sheets

LIQUID CONTAINER AND METHOD OF MANUFACTURING THE SAME

CROSS-REFERENCE TO RELATED APPLICATIONS

The present application is a continuation of U.S. patent application Ser. No. 17/171,904, filed on Feb. 9, 2021, which claims priority from Japanese Patent Application No. 2020-026485, filed Feb. 19, 2020, and Japanese Patent Application No. 2020-196187, filed Nov. 26, 2020, which are hereby incorporated by reference herein in their entireties.

BACKGROUND

Field of the Disclosure

The present disclosure relates to a liquid container and also to a method of manufacturing such a liquid container.

Description of the Related Art

Liquid containers to be mounted in liquid ejection apparatus so as to contain liquid to be ejected from the liquid ejection apparatus have been and are being popularly in use. Japanese Patent Application Laid-Open No. 2019-107823 discloses a liquid container comprising a liquid container bag for containing liquid, a pair of tubes arranged in the inner space of the liquid container bag, each having a first end and a second end, and a connection member fitted to the aperture of the liquid container bag. The first end of each of the pair of tubes is open to the inner space of the liquid container bag and the second end thereof is connected to the connection member. The liquid container further comprises a tube holding member also arranged in the inner space of the liquid container bag. The first ends of the pair of tubes are fastened to the respective corresponding nozzles formed at the holding member.

The holding member described in Japanese Patent Application Laid-Open No. 2019-107823 is formed by using two component members. The reason why is presumably to avoid interference between the mold to be used for molding the holding member and the nozzles. If so, the two component members of the holding member need to be molded by means of two separate molds and, after molding the two component members, the two component members need to be put together which may entail high manufacturing cost.

SUMMARY

An aspect of the present disclosure is to provide a liquid container whose holding member can integrally be molded as a single molded product by modifying the structure of holding member of the liquid container at the tube fastening positions thereof to consequently improve the ink feeding performance of the liquid container. Another aspect is to provide a method of manufacturing a holding member to be used in such a liquid container by way of integral molding.

The present disclosure generally relates to a liquid container to be mounted in a liquid ejection apparatus so as to contain liquid to be ejected from the liquid ejection apparatus and also to a method of manufacturing a holding member to be used in such a liquid container. A liquid container according to the present disclosure includes a cassette, a liquid container bag mounted in the cassette so as to contain liquid to be ejected from a liquid ejection apparatus, and a connection member arranged at an opening part of the liquid container bag, with the opening part being located at an end of the liquid container bag. The liquid container further includes a holding member including a linker portion having opposite ends of which one end is connected to the connection member and the other end is located in an inside of the liquid container bag so as to extend into the inside of the liquid container bag, and a spacer portion connected to the other end of the linker portion. Additionally, the liquid container includes a tube, of which one end is fitted to the spacer portion and the other end is fitted to the connection member so as to draw out liquid from the liquid container bag, with the spacer portion having a main groove for receiving the one end of the tube to be fitted thereinto and an auxiliary groove communicating with the main groove such that a non-contact space is formed partially in the main groove as arranged between an inner lateral surface of the main groove and an outer lateral surface of the tube fitted into the main groove and the auxiliary grove is held in communication with the non-contact space.

A method of manufacturing a holding member to be used in a liquid container employs a first mold having a wall part for forming a main groove for receiving the one end of the tube to be fitted thereinto on one of opposite lateral surfaces of the spacer portion of the holding member, an auxiliary groove held in communication with the main groove and one of opposite lateral surfaces of the connection member, and a second mold having a wall part for forming another main groove for receiving one end of the tube to be fitted thereinto on the other of the opposite lateral surfaces of the spacer portion of the holding member, another auxiliary groove held in communication with the other main groove and the other of the opposite lateral surfaces of the connection member. Each of the wall parts has a portion for forming the main groove with a combination of lateral surfaces forming a right angle or an obtuse angle in cross section perpendicular relative to the extending direction of the main groove.

Further features of the present disclosure will become apparent from the following description of exemplary embodiments with reference to the attached drawings.

BRIEF DESCRIPTION OF THE DRAWINGS

FIG. 3B is an exploded schematic perspective view of the holding member and the connection member of the liquid container shown in FIG. 3A, while

FIG. 4B is an exploded schematic view of the holding member and the connection member shown in FIG. 4A, while

FIG. 5A is a schematic cross-sectional view of the holding member shown in FIG. 3C and taken along line D-D and FIG. 5B is a schematic cross-sectional view of the exemplar arrangement of the holding member shown in FIG. 4A and taken along line B-B, while

DESCRIPTION OF THE EMBODIMENTS

Figure 1:
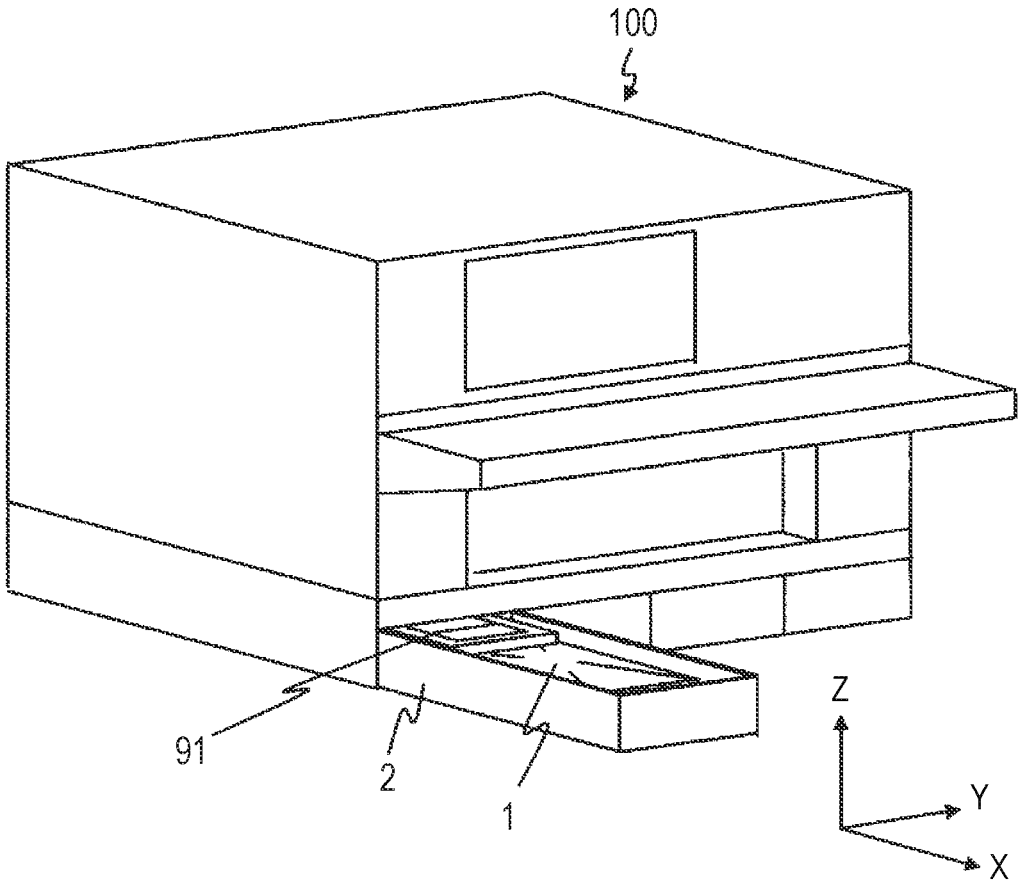
FIG. 1 is a schematic perspective view of a liquid ejection apparatus in which a liquid container according to the present disclosure is mounted.

Now, an embodiment of the present disclosure will be described below by referring to the drawings. In the following description, the liquid ejection apparatus will be an inkjet printer and the liquid employed for the liquid ejection apparatus will be ink, although the present disclosure is by no means limited to the specifics described for the example embodiment. The direction indicted by arrow X (X-direction) is the direction in which a liquid container 1 is driven to move forward toward a liquid ejection apparatus 100 when the liquid container 1 is to be mounted in the liquid ejection apparatus 10 and backward and away from the liquid ejection apparatus 100 when the liquid container 1 is to be removed from the liquid ejection apparatus 100. The direction indicated by arrow Y (Y-direction) is the width direction of the liquid container 1 and the direction indicated by arrow Z (Z-direction) is the thickness direction of the liquid container 1. The X-direction, the Y-direction and the Z-direction are orthogonal relative to one another. The state in which the liquid container 1 is mounted in the liquid ejection apparatus 100 is referred to as "mounted state". Since the liquid container 1 is mounted in the liquid ejection apparatus 100 in the thickness direction of the liquid container 1 that agrees with the vertical direction, the Z-direction agrees with the vertical direction in the mounted state.

FIG. 1 is a schematic perspective view of the liquid ejection apparatus 100 in which an embodiment of liquid container according to the present disclosure has already been mounted in the liquid ejection apparatus 100. The liquid ejection apparatus 100 has a recording medium containing section (not shown), a recording medium conveyance mechanism (not shown) and other components. The liquid container 1 is contained in a cassette 2 and mounted in the liquid ejection apparatus 100. The liquid container 1 contains ink that is to be ejected from the recording head of the liquid ejection apparatus 100. With regard to this embodiment of the present disclosure, a total of four liquid containers 1 respectively containing cyan (C) ink, magenta (M) ink, yellow (Y) ink and black (K) ink are mounted in the liquid ejection apparatus 100. While all the liquid containers 1 have the same size in FIG. 1, the container containing black ink, for instance, may be made bigger than all the remaining liquid containers 1. The cassette 2 that contains the liquid containers 1 is driven to move forward toward the liquid ejection apparatus 100 so as to be mounted in the liquid ejection apparatus 100 and backward and away from the liquid ejection apparatus 100 so as to be removed from the liquid ejection apparatus 100.

Figure 2A:
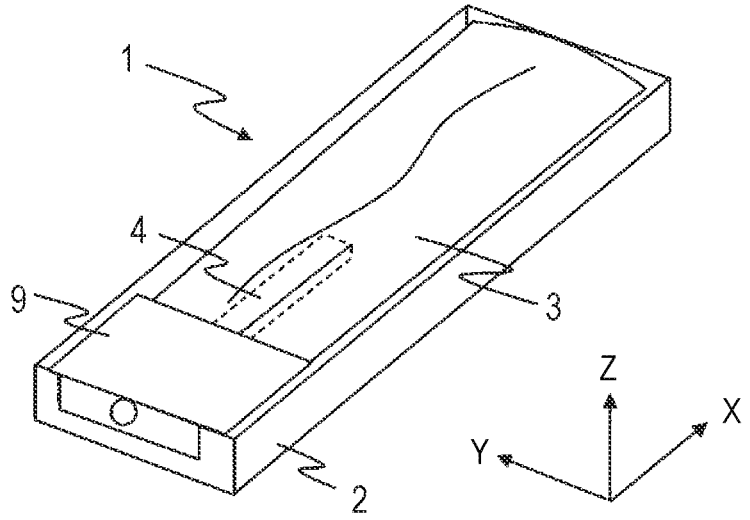
FIG. 2A is a schematic perspective view of an embodiment of liquid container according to the present disclosure and FIG. 2B is an exploded schematic perspective view of the liquid container shown in FIG. 2A.
Figure 2B:
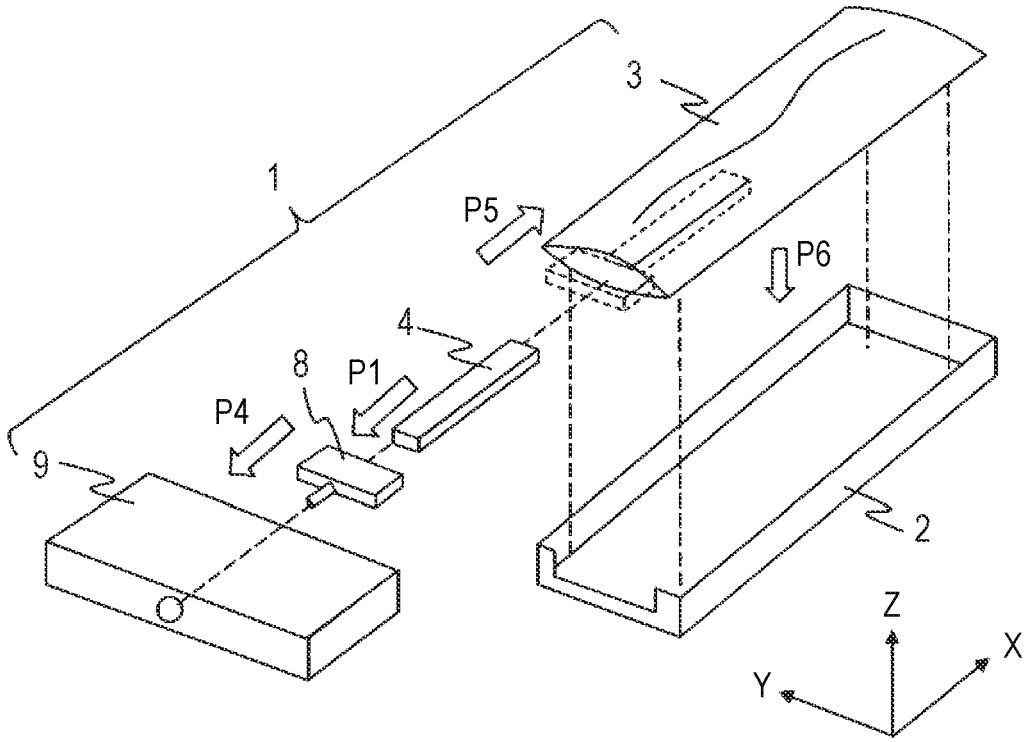
Figure 3A:
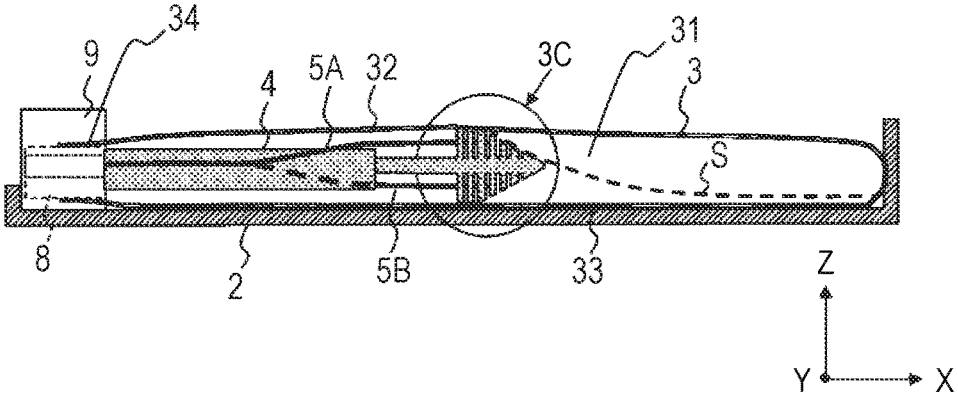
FIG. 3A is a schematic lateral cross-sectional view of the liquid container shown in FIG. 2A
Figure 3B:
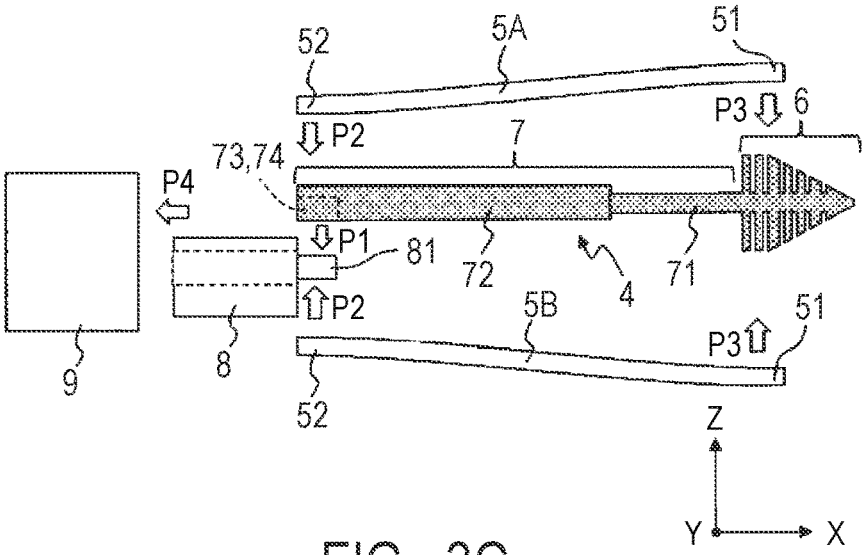
Figure 3C:
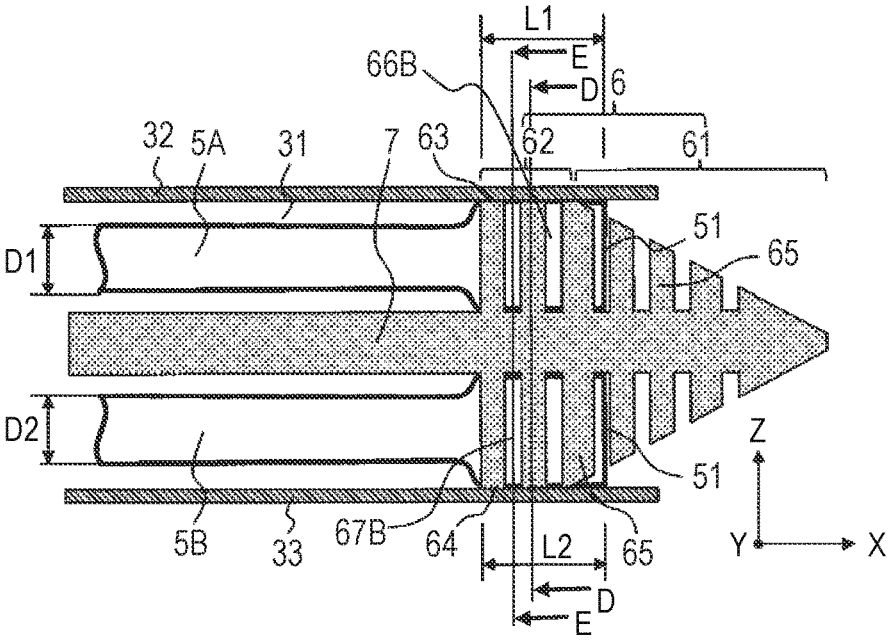
FIG. 3C is an enlarged schematic view of the 3C region shown in FIG. 3A and surrounded by a circle there.
Figure 4A:
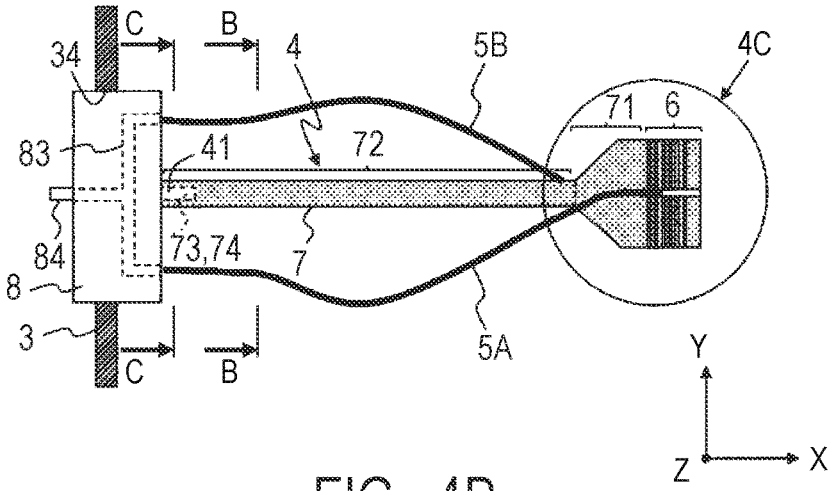
FIG. 4A is a schematic top view of the liquid container shown in FIG. 2A, showing the holding member and the connection member thereof
Figure 4B:
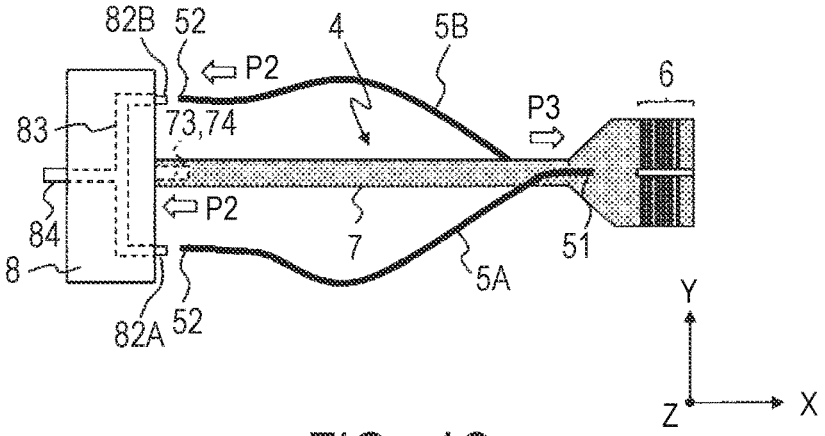
Figure 4C:
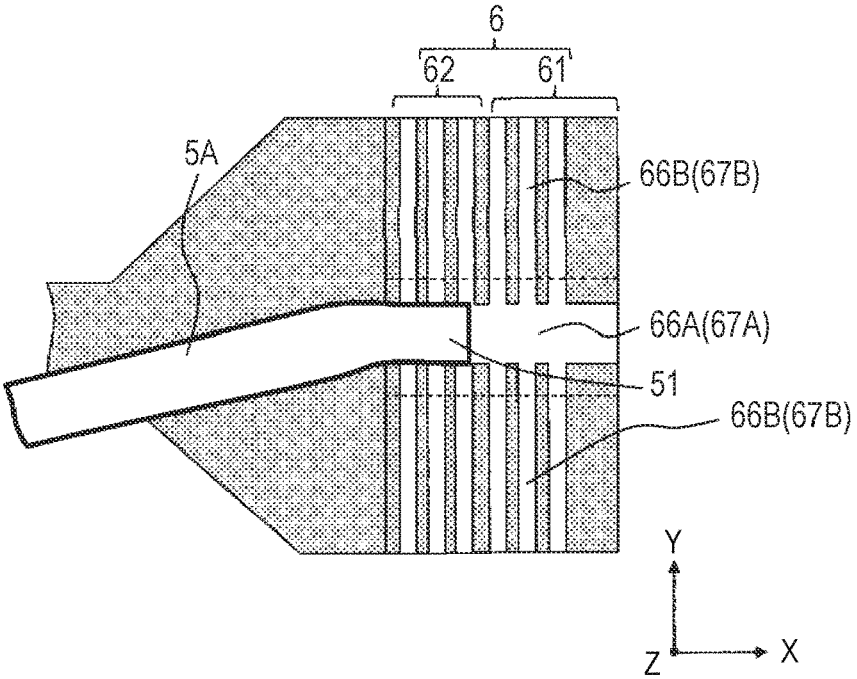
FIG. 4C is an enlarged schematic view of the 4C region shown in FIG. 4A and surrounded by a circle.

FIG. 2A is a schematic perspective view of the liquid container according 1 and FIG. 2B is an exploded schematic perspective view of the liquid container 1, illustrating the sequence of assembling the liquid container 1. FIG. 3A is a schematic lateral cross-sectional view of the liquid container 1 and FIG. 3B is an exploded schematic lateral view of the liquid container 1, illustrating the sequence of assembling the internal structure of the liquid container 1, while FIG. 3C is an enlarged schematic view of the encircled 3C region shown in FIG. 3A. FIG. 4A is a schematic top view of the liquid container 1 and FIG. 4B is an exploded schematic top view of the liquid container 1, illustrating how tubes are fitted to the liquid container 1, while FIG. 4C is an enlarged schematic top view of the encircled 4C region shown in FIG. 4A.

As will be described hereinafter, the holding member 4 is formed to include a linker portion 7 and a spacer portion 6. However, both the linker portion 7 and the spacer portion 6 are omitted from FIG. 2A and FIG. 2B and only the entire holding member 4 is shown there. The tube or tubes 5 for drawing out ink are also omitted from FIG. 2A and FIG. 2B.

As shown in FIGS. 2A and 2B, the liquid container 1 includes a liquid container bag 3 for containing ink in it. The liquid container bag is preferably made of a flexible material. A tube or tubes (not shown) for drawing out ink from the inside of the bag toward the recording head and a holding member 4 are arranged in the inner space of the liquid container bag 3. The number of tubes is not specifically defined. In other words, it is sufficient to say that at least a tube is arranged, while a pair of tubes are arranged as shown in FIGS. 3A through 3C in this embodiment. One of the tubes is referred to as the first tube 5A and the other tube is referred to as the second tube 5B hereinafter. The first tube 5A and the second tube 5B operate as so many ink flow paths for allowing ink to flow through them. Both the first tube 5A and the second tube 5B are formed by using an elastic material such as elastomer. Each of the first tube 5A and the second tube 5B has a first end 51 and a second end 52 and extends substantially in the X-direction between the spacer portion 6A and the connection member 8, which will be described in greater detail hereinafter. The first ends 51 of both the first tube 5A and the second tube 5B are respectively placed in and fitted into the corresponding grooves formed in the spacer portion 6 as will be described in greater detail hereinafter. Additionally, the first ends 51 of both the first tube 5A and the second tube 5B are open to the inner space 31 of the liquid container bag 3. The second ends 52 of both the first tube 5A and the second tube 5B are, on the other hand, connected to the connection member 8. Note that, when viewed in the Z-direction, the openings of the first ends 51 are substantially located in the central part of the liquid container bag 3. Additionally, in the mounted state, the first end 51 of the first tube 5A is located in an upper part of the inner space 31, whereas the first end 51 of the second tube 5B is located in a lower part of the inner space 31. The ink to be used in this embodiment contains one or more precipitation components (such as a pigment) and, as time goes by, the concentration of the precipitation component(s) will fall in an upper part of the liquid container bag 3 and rise in a lower part of the liquid container 3. Thus, consequently, when ink is supplied (drawn out) from the liquid container bag 3, low concentration ink is supplied (drawn out) from the first tube 5A and, at the same time, high concentration ink is supplied (drawn out) by way of the second tube 5B. Then, the low concentration ink drawn out by way of the first tube 5A and the high concentration ink drawn out by way of the second tube 5B are mixed and the two different concentrations are averaged to minimize the change with time of the recording quality that the liquid ejection apparatus 100 provides.

As seen from FIGS. 3A through 3C, the holding member 4 has a spacer portion 6 that is interposed between the top surface 32 and the bottom surface 33 of the liquid container bag 3 in the mounted state of the liquid container 1 and a linker portion 7 that is connected to the spacer portion 6 and extends in the direction in which both the first and second tubes 5A and 5B extend (the X-direction) in the mounted state of the liquid container 1. The holding member 4 is made of a synthetic resin material such as polyethylene or polypropylene and integrally molded by means of a mold as will be described in greater detail hereinafter.

Figure 5A:
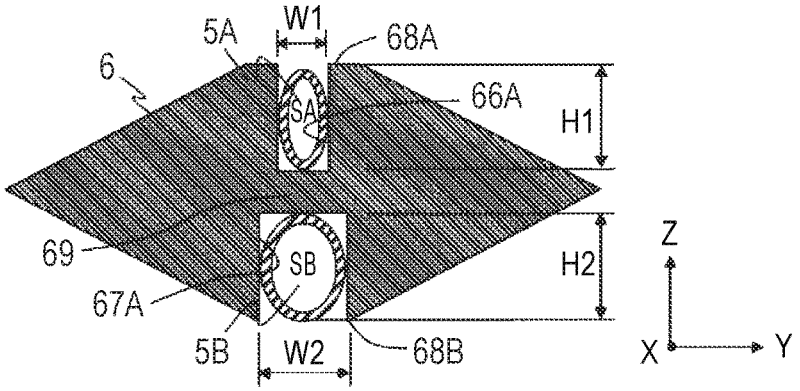

As shown in FIGS. 3A through 3C and FIGS. 4A through 4C, the spacer portion 6 is substantially symmetrical relative to the center line thereof extending in the X-direction both in terms of X-Z plane and in terms of X-Y plane. As seen from FIG. 3C, the spacer portion 6 shows a pentagonal profile and includes a triangular front section 61 and a rectangular rear section 62 as viewed in the Y-direction. On the other hand, as seen from FIG. 4C, the spacer portion 6 shows a substantially rectangular profile as viewed in the Z-direction. Furthermore, as shown in FIG. 3C, the height (the size in the Z-direction) of the front section 61 rises toward the rear section 62, whereas the height (the size in the Z-direction) of the rear section 62 substantially remains constant. Additionally, as shown in FIG. 5A, the front section 61 has a tapered profile and the width (the size in the Y-direction) of the front section 61 becomes narrower as a function of the distance from the center of the front section 61 as viewed in the Z-direction. Differently stated, as shown in FIG. 3C, the front section 61 has downhill slopes in the X-direction and the height of the front section 61 falls as a function of the distance from the rear section 62, while, as shown in FIG. 5A, the front section 61 also has downhill slopes in the Y-direction and the height of the front section 61 falls as a function of the distance from the X-direction center line. As shown in FIG. 3C, the height of the rear section 62 is greatest in the holding member 4 and the bottom 64 of the rear section 62 is held in contact with the lower surface 33 of the liquid container bag 3 in the mounted state of the liquid container 1. The top 63 of the rear section 61 may not necessarily be held in contact with the upper surface 32 of the liquid container bag 3 depending of the amount of ink left in the liquid container bag 3. However, as the ink in the liquid container bag 3 is consumed and the liquid container bag 3 contracts, the top 63 of the rear section 62 eventually comes into contact with the upper surface 32 of the liquid container bag 3. The spacer portion 6 secures a constant height in the central part of the liquid container bag 3 regardless of the amount of ink left in the liquid container bag 3. In other words, the rear section 62 secures a given space in the central part of the liquid container bag 3. As the ink in the liquid container bag 3 is consumed, the upper surface 32 and the lower surface 33 of the liquid container bag 3 come close to each other as indicated by broken line S in FIG. 3A and ultimately the upper surface 32 comes into tight contact with the lower surface 33 so that ink can no longer be drawn out from the liquid container bag 3. As will be described in greater detail hereinafter, the first ends 51 of the first and second tubes 5A and 5B are fitted into and supported by the spacer portion 6 so that a space is secured by the spacer portion 6 around each of the first ends 51 and hence ink is drawn out from the liquid container bag 3 to the last drop. As described above, the spacer portion 6 operates to prevent the first ends 51 from being closed if the amount of ink left in the liquid container bag 3 becomes very small and allows the ink in the liquid container bag 3 to be drawn out to the last drop to maximize the efficiency of ink utilization.

As shown in FIG. 3C, the spacer portion 6 has a plurality of walls 65 that extend vertically (in the Z-direction) in parallel with each other as viewed in the X-direction and separated from each other also in the X-direction. A groove 66A (see FIG. 4C) and grooves 66B that are held in communication with the inner space 31 of the liquid container bag 3 are formed among the plurality of upwardly extending walls 65. In other words, as shown in FIG. 4C, the grooves include a main groove 66A (to be referred to as the first main groove hereinafter) that runs through the spacer portion 6 and extends in the X-direction and a plurality of auxiliary grooves 66B (to be referred to as the first auxiliary grooves hereinafter) that runs orthogonally relative to the first main groove 66A and extends in the Y-direction. The first auxiliary grooves 66B are arranged on the opposite sides of the first main groove 66A as viewed in the Y-direction. The spacer portion 6 shown in FIG. 4C also has grooves arranged among a plurality of walls 65 extending downwardly and oppositely relative to the upward direction (at the rear surface side) as shown in FIG. 5A. The spacer portion 6 also has a main groove 67A (to be referred to as the second main groove hereinafter) that is broader than the first main groove as indicated by broken lines on the rear side of the first main groove 66A as shown in FIG. 4C and a plurality of auxiliary grooves 67B (to be referred to as the second auxiliary grooves hereinafter) that run orthogonally relative to the second main groove 67A and extend in the Y-direction. The second auxiliary grooves 67B are arranged on the opposite sides of the second main groove 67A as viewed in the Y-direction. Note that, in FIG. 4C, the reference symbols 67A and 67B are put in the respective sets of parentheses and shown respectively after the reference symbols 66A and 66B in order to tell that the second main groove 67A and the second auxiliary grooves 67B are arranged at the respective positions located on the hind sides of the first main groove 66A and the first auxiliary grooves 66B. Even when the amount of ink in the liquid container bag 3 is decreased to bring the upper surface 32 of the liquid container bag 3 into tight contact with the spacer portion 6, ink flows into the inside of the spacer portion 6 from the first main groove 66A and the first auxiliary grooves 66B. Additionally, even when the lower surface 33 of the liquid container bag 3 is brought into tight contact with the spacer portion 6, ink effectively flows into the inside of the spacer portion 6 from the second main groove 67A and the second auxiliary grooves 67B. In short, the first main groove 66A, the first auxiliary grooves 66B, the second main groove 67A and the second auxiliary grooves 67B operate to effectively raise the efficiency of ink utilization.

Figure 6:
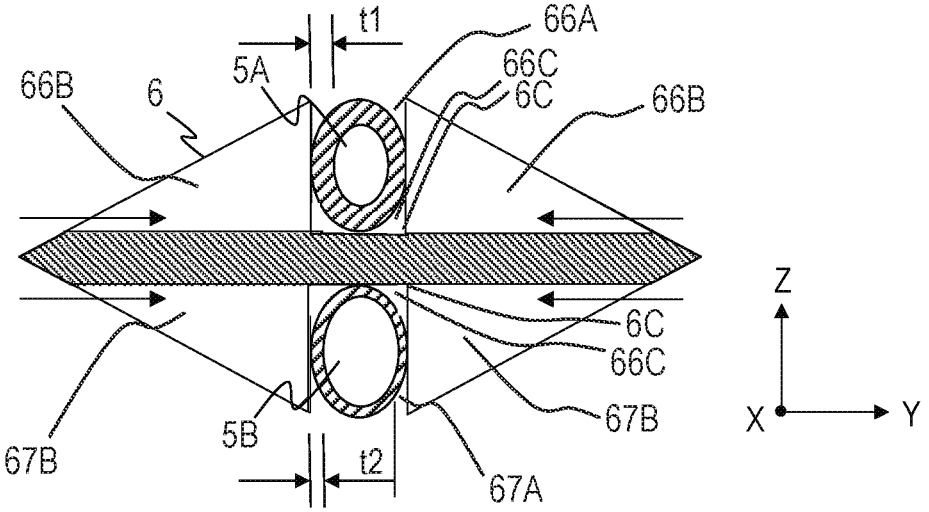
FIG. 6 is a schematic cross-sectional view of the holding member shown in FIG. 3C and taken along line E-E.

The configuration of the spacer portion 6 will be described below in greater detail by referring to FIG. 6 (a cross-sectional view taken along line E-E in FIG. 3C). For the purpose of simplification of explanation, the configuration of the spacer portion 6 will be described only by way of the first main groove 66A, the first auxiliary grooves 66B and the tube 5A located on the upper side of the spacer portion 6. Of the main groove 66A, the angles (to be referred to as angle parts 6C for the sake of convenience) formed by the surfaces that operate as the lateral walls of the groove and the surface that operates as the bottom surface are substantially right angles. As the first main groove is made to have angle parts 6C, the tube (on an assumption that the tube is generally cylindrical in shape) fitted to the groove produces a space part 66C because the groove is not held in contact with any angle parts 6C. For instance, ink flows from the first auxiliary grooves 66B into the space part 66C that is formed at the angle parts 6C of the main groove 66A and then can flow through the space part 66C and move to the first end 51 of the tube 5A to consequently extremely minimize the amount of ink left among the first auxiliary grooves 66B and effectively raise the efficiency of ink utilization. However, when the angle parts 6C do not show any right angle but show a curved surface of a curvature similar to the curvature of the tube 5A, no space part 66C is produced in the region where the angle parts 6C are formed. Then, the ink that flows from the first auxiliary grooves 66B to the first main groove 66A is blocked by the tube 5A. Then, as a result, the ink can no longer move further on and the amount of ink remaining among the first auxiliary grooves 66B increases to in turn decrease the efficiency of ink utilization.

Figure 7A:
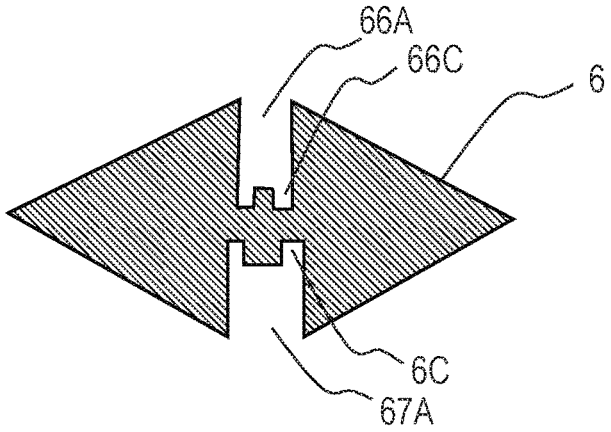
FIGS. 7A, 7B and 7C are schematic cross-sectional views of three alternative arrangements of the holding member to which the present disclosure is applicable.
Figure 7B:
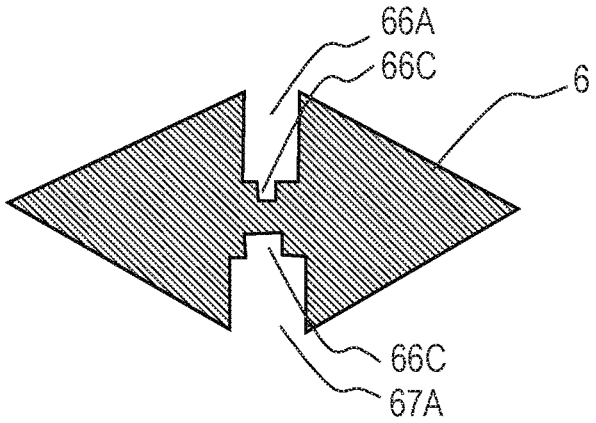
Figure 7C:
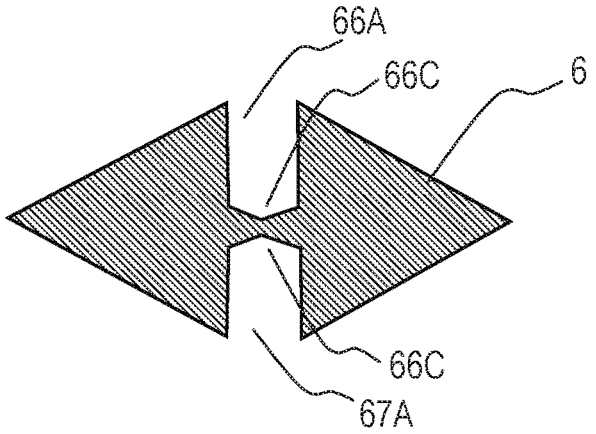

FIGS. 7A through 7C schematically illustrate alternative configurations of the main groove 66A that includes angle parts 6C. FIG. 7A shows an arrangement where a protrusion is formed on the lateral surface that operates as the bottom surface of the main groove 66A. FIG. 7B shows an arrangement where a recess is formed on the surface that operates as the button surface of the main grooves 66A. With either of the arrangements that are described above, the disadvantage of the situation where the tube is deformed along the main groove 66A because of the flexibility of the tube to practically eliminate the space part 66C can be reduced. In other words, the space part 66C is secured to allow ink to flow into the angle parts 6C. When the tube is practically free from any deformation, the angle parts 6C may be made to show an obtuse angle as shown in FIG. 7C and the bottom surface of the groove may be allowed to show a polygonal profile. Note that it is needless to say that the angle parts 6C may be made to show a sharp angle. However, from the viewpoint of making the method of manufacturing the holding member 4 a simple one as will be described hereinafter, the use of angle parts 6C that show a right angle or an obtuse angle is preferable because the use of such angle parts 6C allows to facilitate the release of the mold from the molded holding member.

As shown in FIGS. 3A through 3C and FIGS. 4A through 4C, the linker portion 7 and the spacer portion 6 of the holding member 4 of this embodiment are integrally molded. The linker portion 7 includes a transitional section 71 that is connected to the polygon-shaped spacer portion 6 and a shaft section 72 connected to the transitional section 71 and extending in the X-direction. Any Y-Z cross sections of the shaft section 72 taken along the X-direction are substantially the same and constant. The linker portion 7 is locked and connected to the connection member 8 by means of a locking part 73 arranged at the end 41 (see FIG. 4A) of the linker portion 7 that is opposite to the end thereof connected to the spacer section 6. The connection member 8 has a cylindrical locking protrusion 81 (see FIG. 3B) at a position located vis-a-vis the linker portion 7 (of the holding member 4) and the locking part 73 of the linker portion 7 is locked to the locking protrusion 81. The locking part 73 has an opening 74 on the top surface or on the bottom surface thereof so as to be mated with the locking protrusion 81. Thus, as the locking protrusion 81 is put into and mated with the opening 74, the holding member 4 can be made to be supported by the connection member 8 at the end 41 of the holding member 4.

Figure 5B:
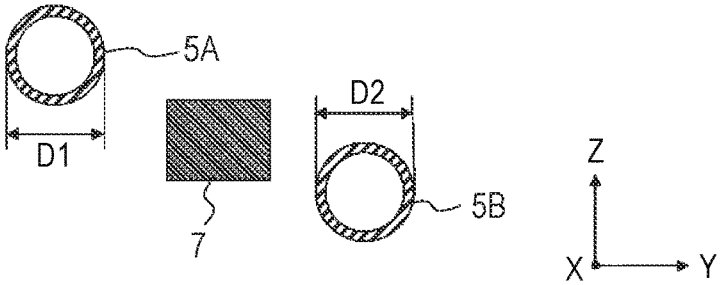
Figure 5C:
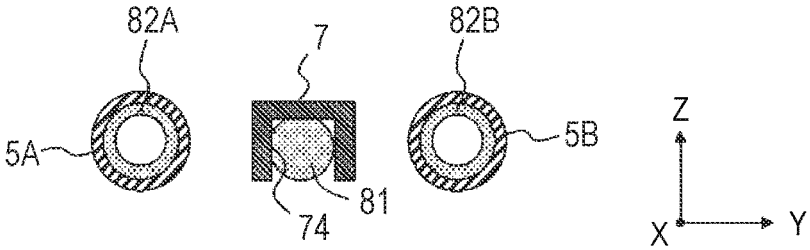
FIG. 5C is a schematic cross-sectional view of the exemplar arrangement of the holding member shown in FIG. 4A and taken along line C-C and FIG. 5D is a schematic cross-sectional view of an alternative exemplar arrangement of the holding member.

As shown in FIG. 3A, the connection member 8 is fitted to the aperture 34 of the liquid container bag 3. Additionally, as shown in FIG. 4B, the connection member 8 has a first nozzle 82A to which the second end 52 of the first tube 5A is fitted and a second nozzle 82B to which the second end 52 of the second tube 5B is fitted. As the second end 52 of the first tube 5A and the second end 52 of the second tube 5B are respectively attached to the first nozzle 82A and the second nozzle 82B, the first tube 5A is connected to the first nozzle 82A and the second tube 5B is connected to the second nozzle 82B. Both the first nozzle 82A and the second nozzle 82B communicate with the internal flow path 83 of the connection member 8 and the ink flowing in from the first tube 5A and the ink flowing in from the second tube 5B join together in the internal flow path 83. An ink supply port 84 is arranged on the surface of the connection member 8 on the side of the connection member 8 located opposite to the side of the connection member 8 where the first and second nozzles 82A and 82B are arranged and the ink supply port 84 is to be connected to the liquid ejection apparatus 100. FIG. 5C is a schematic cross-sectional view taken along line C-C in FIG. 4A. As shown in FIG. 5C, the first nozzle 82A, the second nozzle 82B and the locking protrusion 81 are flush with each other in terms of the Z-direction and the locking protrusion 81 is located between the first nozzle 82A and the second nozzle 82B. As shown in FIG. 2B, the connection member 8 is contained in a retaining member 9. The retaining member 9 has a rotatable handle 91 (see FIG. 1) and a guide section (not shown) so that the liquid container 1 can be put into and taken away from the liquid ejection apparatus 100 by grasping the handle 91 and moving the liquid container 1 along the guide section (not shown) that is provided for the cassette 2.

As described above, the spacer portion 6 of the holding member 4 is provided with the first main groove 66A, into which the first end 51 of the first tube 5A is to be fitted, and the second main groove 67A, into which the first end 51 of the second tube 5B is to be fitted. FIG. 5A is a schematic cross-sectional view taken along line D-D in FIG. 3C. In the mounted state as shown in FIG. 5A, the first main groove 66A is found in an upper part of the spacer portion 6 and the second main groove 67A is found in a lower part of the spacer portion 6. While the positions where the first and second main grooves 66A and 67A are respectively arranged are not subject to any particular limitations, preferably, the first main groove 66A is arranged in the first top region 68A that is located closest to the upper surface 32 of the liquid container bag 3 and the second main groove 67A is arranged in the second top region 68B that is located closest to the lower surface 33 of the liquid container bag 3. Since the spacer portion 6 shows a large height (a large size as viewed in the Z-direction) in these regions, it is possible to secure a satisfactory depth for both the first main groove 66A and the second main groove 67A with ease.

The first tube 5A and the second tube 5B are held in position by the connection member 8 and the spacer portion 6 of the holding member 4. It is highly preferable that the first tube 5A is snugly fitted into the first main groove 66A at the first end 51 thereof and the second tube 5B is snugly fitted into the second main groove 67A at the first end 51 thereof in order to securely and stably hold the first tube 5A and the second tube 5B in position. However, the part of the first tube 5A that is to be fitted into the first main groove 66A is not limited to the first end 51 thereof and the part of the second tube 5B that is to be fitted into the second main groove 67A is not limited to the first end 51 there either. In other words, the first tube 5A may be fitted into the first main groove 66A at any part thereof other than its second end. Similarly, the second tube 5B may be fitted into the second main groove 67A at any part thereof other than its second end. For example, it may be so arranged that a region of the first tube 5A including its first end 51 projects from the first main groove 66A in the X-direction just like a cantilever. Similarly, it may be so arranged that a region of the second tube 5B including its second end 51 projects from the second main groove 67A in the X-direction just like a cantilever. However, the way in which the first tube 5A is most securely and stably held in position to eliminate a situation where ink is not drawn out reliably and stably is that the first tube 5A is fitted into the first main groove 66A at the first end 51 thereof and the way in which the second tube 5B is most securely and stably held in position to eliminate a situation where ink is not drawn out reliably and stably is that the second tube 5B is fitted into the second main groove 67A at the first end 51 thereof.

Preferably, the first tube 5A is fitted into the first main groove 66A by a length greater than its outer diameter and, similarly, the second tube 5B is fitted into the second main groove 67A by a length greater than its outer diameter. Assume here that the outer diameter of the first tube 5A is D1 and the length of the part of the first tube 5A that is fitted into the first main groove 66A is L1 and that the outer diameter of the second tube 5B is D2 and the length of the part of the second tube 5B that is fitted into the second main groove 67A is L2 as shown in FIG. 3C. Then, preferably, the relationships of L1≥D1 and L2≥D2 hold true. Additionally and preferably, as shown in FIG. 5A, the part of the first tube 5A that is fitted into the first main groove 66A and becomes invisible as viewed in the Y-direction has a height at least greater than a half (½) of the outer diameter of the first tube 5A and the part of the second tube 5B that is fitted into the second main groove 67A and becomes invisible as viewed in the Y-direction has a height at least greater than a half (½) of the outer diameter of the second tube 5B. Assume here that the depth by which the part of the first tube 5A is put into the first main groove 66A is H1 and the depth by which the part of the second tube 5B is put into the second main groove 67A is H2. Then, preferably, the relationships of H1≥D1/2 and H2≥D2/2 hold true. As shown in FIG. 5B (a cross-sectional view taken along line B-B in FIG. 4A), the value of the outer diameter of the part of the first tube 5A that is not fitted into the first main groove 66A is given as the outer diameter D1 of the first tube 5A and the value of the outer diameter of the part of the second tube 5B that is not fitted into the second main groove 67A is given as the outer diameter D2 of the second tube 5B. In other words, the value of the diameter of the part of the first tube 5A that is to be fitted into the first main groove 66A before it is actually fitted into the first main groove 66A may be given as the outer diameter D1 of the first tube 5A and the value of the diameter of the part of the second tube 5B that is to be fitted into the second main groove 67A before it is actually fitted into the second main groove 67A may be given as the outer diameter D2 of the second tube 5B. In short, the value of the outer diameter of the first tube 5A that is free from stress is given as D1 and, similarly, the value of the outer diameter of the second tube 5B that is free from stress is given as D2. Preferably, the first tube 5A is pushed into the first main groove 66A until it gets to the bottom surface of the first main groove 66A and, similarly, the second tube 5B is pushed into the second main groove 67A until it gets to the bottom surface of the second main groove 67A. Then, the depth H1 may practically agree with the depth of the first main groove 66A and the depth H2 may practically agree with the depth of the second main groove 67A. Additionally and preferably, the width of the first main groove 66A is smaller than the outer diameter of the first tube 5A and the width of the second main groove 67A is smaller than the outer diameter of the second tube 5B. Assume here that the width of the first main groove 66A is W1 and the width of the second main groove 67A is W2. Then, preferably, the relationships of D1>W1 and D2>W2 hold true. Differently stated, the first tube 5A is fitted into the first main groove 66A in a state of being compressed by the first main groove 66A and the second tube 5B is fitted into the second main groove 67A in a state of being compressed by the second main groove 67A. With such an arrangement, the first tube 5A is reliably and rigidly held in the first main groove 66A due to the frictional force that arises between the first tube 5A and the first main groove 66A and the second tube 5B is reliably and rigidly held in the second main groove 67A due to the frictional force that arises between the second tube 5B and the second main groove 67A.

When some, preferably all, of the above-defined relationship requirements are satisfied, the first tube 5A is reliably and stably held in the first main groove 66A and the second tube 5B is reliably and stably held in the second main groove 67A so that the first tube 5A may hardly come off from the first main groove 66A and the second tube 5B may hardly come off from the second main groove 67A. As an example, both the outer diameter D1 of the first tube 5A and the outer diameter D2 of the second tube 5B are equal to 6 mm and the both the inner diameter of the first tube 5A and the inner diameter of the second tube 5B are equal to 4 mm, while the width W1 of the first main groove 66A is equal to 3 mm and the width W2 of the second main groove 67A is equal to 4 mm. Both the depth of the first main groove 66A and the depth of the second main grove 67A are equal to 6 mm and both the length L1 of the part of the first tube 5A that is put into the first main groove 66A and the length L2 of the part of the second tube 5B that is put into the second main groove 67A are equal to 6 mm. Even when the width W1 of the first main groove 66A is equal to the outer diameter D1 of the first tube 5A, the first tube 5A is reliably and stably held in the first main groove 66A so long as the first tube 5A is held in contact with the lateral walls of the first main groove 66A so as to give rise to friction between the first tube 5A and the lateral walls of the first main groove 66A. This statement is also applicable to the relationship between the width W2 of the second groove 67A and the outer diameter D2 of the second tube 5B. It is sufficient for the width W1 of the first main groove 66A to be not greater than the outer diameter D1 of the first tube 5A and for the width W2 of the second main groove 67A to be not greater than the outer diameter D2 of the second tube 5B.

Figure 5D:
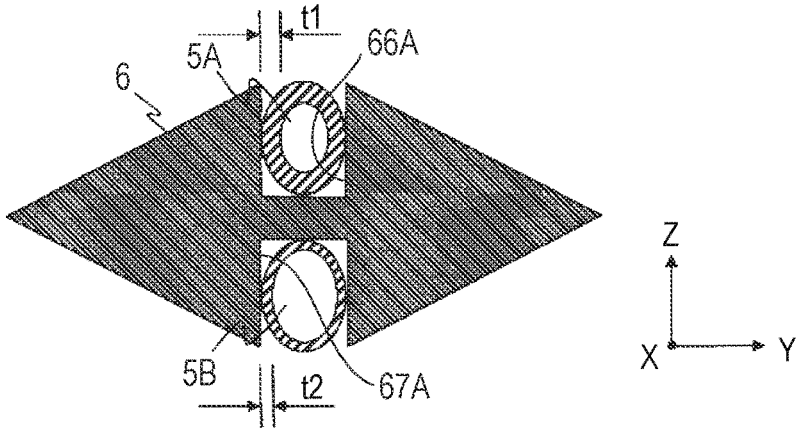

As described earlier, ink to be used for this embodiment contains one or more than one precipitation components and, as time goes by, the concentration of the precipitation component(s) will fall in an upper part of the liquid container bag 3 and rise in a lower part of the liquid container 3. Thus, with the above-described positional arrangement of the tubes for drawing out ink, the first tube 5A takes in ink whose concentration of the precipitation component(s) is relatively low while the second tube 5B takes in ink whose concentration of the precipitation component(s) is relatively high. In this operation, preferably the second tube 5B takes in ink more than the first tube 5A in order to prevent the rise of the concentration of the precipitation component(s) in the ink left in the liquid container bag 3. For this purpose, as shown in FIG. 5A, the smallest cross-sectional area of the liquid flow path of the second tube 5B is made greater than the smallest cross-sectional area of the liquid flow path of the first tube 5A in this embodiment. More specifically, the cross-sectional area SB of the liquid flow path of the part of the second tube 5B that is fitted into the second main groove 67A is made greater than the cross-sectional area SA of the liquid flow path of the part of the first tube 5A that is fitted into the first main groove 66A. With this arrangement, the flow path resistance of the second tube 5B is made smaller than the flow path resistance of the first tube 5A so that the second tube 5B can take in ink whose concentration of the precipitation component(s) is high with ease. Then, the ink that is found in a lower part of the liquid container bag 3 and shows a high concentration of the precipitation component(s) can efficiently be drawn into the second tube 5B. A first tube 5A and a second tube 5B that have the same outer diameter and the same wall thickness are employed for the arrangement illustrated in FIG. 5A. With the arrangement of FIG. 5A, the depth H1 of the first main groove 66A is made to be equal to the depth H2 of the second main groove 67A and the width W2 of the second main groove 67A is made to be greater than the width W1 of the first main groove 66A but smaller than the outer diameter of the second tube 5B. With the above-described arrangement, tubes having same dimensions in terms of outer diameter and wall thickness can be employed for the first tube 5A and the second tube 5B so that the use of such a first tube 5A and a second tube 5B is advantageous from the viewpoint of production management. Note, however, that the arrangement as shown in FIG. 5D is also feasible. With the arrangement shown in FIG. 5D, the width W and the depth H of the first main groove 66A are respectively made to be equal to the width W and the depth H of the second main groove 67A and the outer diameter of the first tube 5A is made to be equal to the outer diameter of the second tube 5B. In this instance, the cross-sectional area SA of the flow path of the first tube 5A and the cross-sectional area SB of the flow path of the second tube 5B can be made to satisfy the relationship requirement of SB>SA by making the wall thickness t2 of the second tube 5B smaller than the wall thickness t1 of the first tube 5A (and hence making the inner diameter of the second tube 5B greater than the inner diameter of the first tube 5A) to achieve the intended effect and provide the intended advantage. While the width of the first main groove 66A is made to be equal to the width of the second main groove 67A in the instance of FIG. 5D, the two widths may be made different from each other so long as the relationship requirement of SB>SA is satisfied. Note that the width and the depth of the first main groove 66A and those of the second main groove 67A can appropriately be modified so long as neither of the first tube 5A and the second tube 5B are completely crushed and neither of their liquid flow paths are blocked. Furthermore, the outer diameter of the second tube 5B may be made to be greater than the outer diameter of the first tube 5A to allow more ink to flow through the second tube 5B than through the first tube 5A.

Figure 8A:
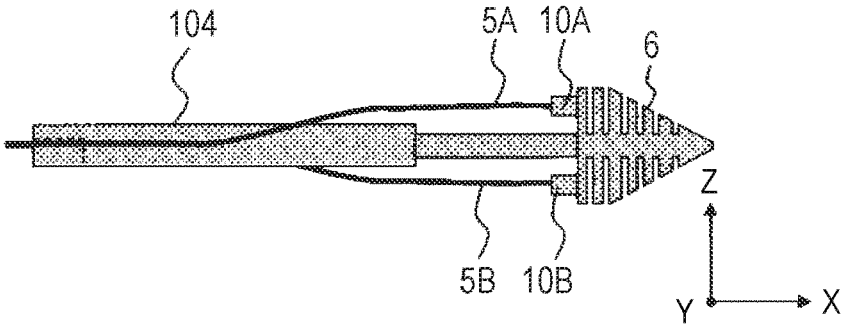
FIGS. 8A, 8B and 8C are schematic lateral cross-sectional views of the liquid container of the comparative example, illustrating a method of manufacturing the holding member.

Of this embodiment, as described above, the holding member 4, which includes the linker portion 7 and the spacer portion 6, is made to have a configuration that is suited for integral molding so that the holding member 4 can be produced by way of a simplified manufacturing process. This advantage of this embodiment will be described by comparing this embodiment with the liquid container of the comparative example shown in FIGS. 8A through 8C. FIG. 8A is a schematic lateral view of the holding member 104 of the comparative example. In the liquid container of the comparative example, the spacer portion 6 is provided with additional nozzles 10A and 10B for respectively holding the first end 51 of the first tube 5A and the first end 51 of the second tube 5B. The additional nozzles 10A and 10B show a configuration similar to that of the first and second nozzles 82A and 82B of the connection member 8 shown in FIG. 4B. As the first and second tubes 5A and 5B are respectively attached to the additional nozzles 10A and 10B such that the first and second tubes 5A and 5B partly cover the additional nozzles 10A and 10B, the first tube 5A and the second tube 5B can be made to be reliable and stably held by the spacer portion 6.

Figure 8B:
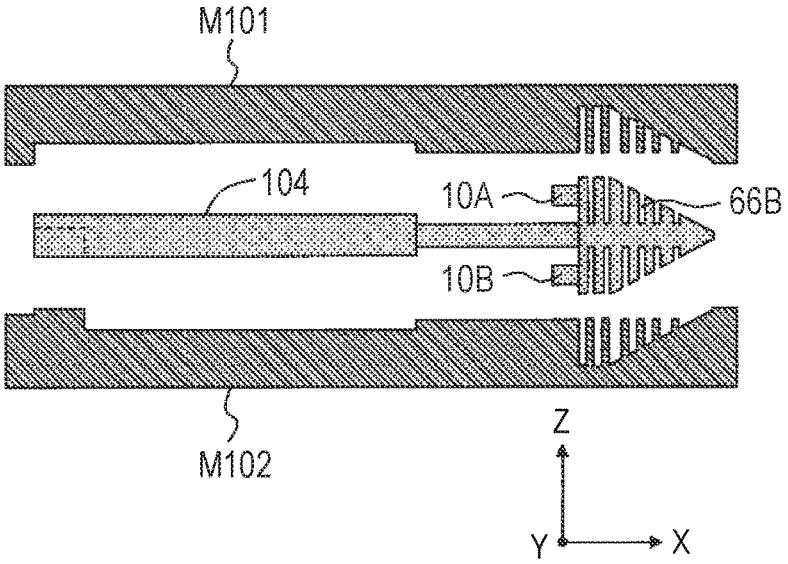
Figure 8C:
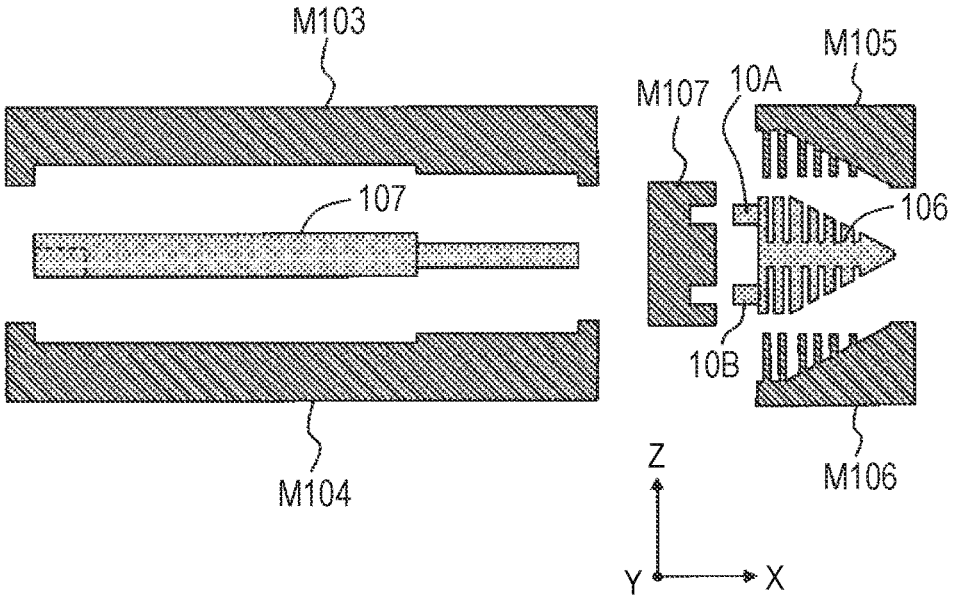

FIG. 8B shows how the holding member 104 of the comparative example is produced by injection molding. The holding member 104 can theoretically be molded by a mold having an upper mold half M101 and a lower mold half M102 as shown in FIG. 5B. The main groove 66A and the auxiliary grooves 66B of the spacer portion 6 are formed by the upper mold half M101 and the lower mold half M102. However, in actuality, because the additional nozzle 10A interferes with the upper mold half M101 and the additional nozzle 10B interferes with the lower mold half M102, it is not possible to produce the holding member 104 of the comparative example simply by means of the mold shown in FIG. 8B. Therefore, as shown in FIG. 8C, it is necessary to separate the spacer portion 106 and the linker portion 107 of the holding member 104 from each other and produce the spacer portion 106 and the linker portion 107 separately by means of respective dedicated molds. More specifically, the linker portion 107 is produced by using a dedicated mold having an upper mold half M103 and a lower mold half M104 and, similarly, the spacer portion 106 is produced by using a dedicated mold having an upper mold half M105 and a lower mold half M106. Furthermore, the use of an additional partial mold M107 that can be made to slide horizontally is required to release the mold halves M105 and M106 and the partial mold M107 from the molded spacer portion 106. Moreover, the spacer portion 106 needs to be provided with a mating section and the linker portion 107 needs to be provided with a corresponding mating section for putting the spacer portion 106 and the linker portion 107 together into a complete holding member 104. Thus, for the holding member 104 of the comparative example, the spacer portion 106 and the linker portion 107 need to be molded by means of separate molds and then the molded spacer portion 106 and the molded linker portion 107 need to be put together to produce the complete holding member 104.

Figure 9:
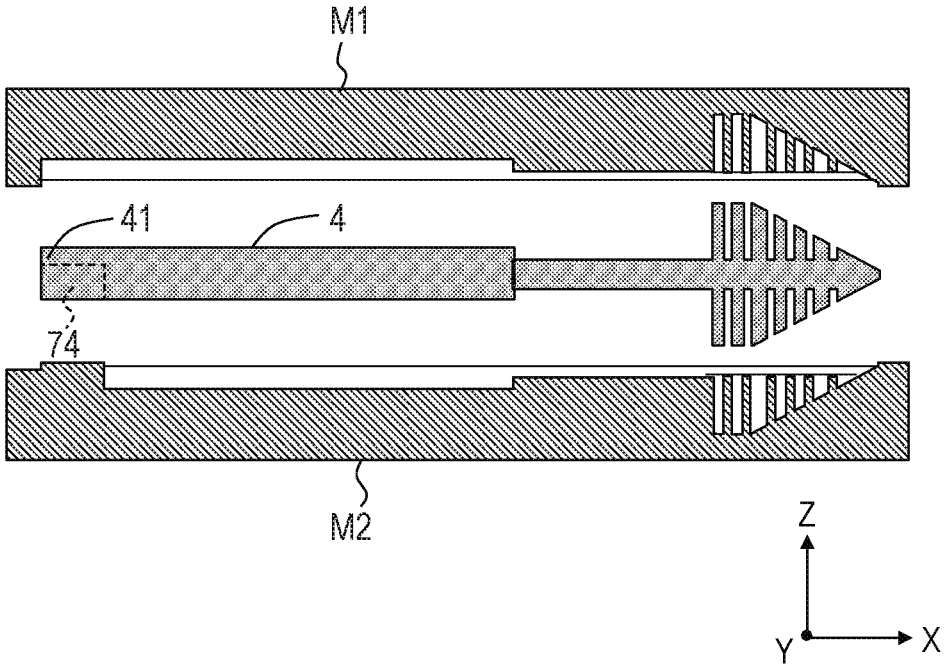
FIG. 9 is a schematic lateral view of the holding member shown in FIG. 3B, illustrating the method of manufacturing the same according to the present disclosure.

FIG. 9 shows how the holding member 4 of this embodiment is produced by means of injection molding, using a mold having an upper mold half M1 and a lower mold half M2. Unlike the above-described comparative example, the spacer portion 6 is not provided with any additional nozzles 10A and 10B. Therefore, the entire holding member 4 can be molded by means of a mold having an upper mold half M1 and a lower mold half M2. Since the end 41 of the holding member 4 on the side of the connection member 8 is upwardly or downwardly open, the lower mold half M2 can be released from the opening 74 of the end 41 without problem. Since this holding member 4 does not require additional nozzles 10A and 10B, the pressure loss of the holding member 4 of this embodiment is held to be very small to obtain the advantage of improving the efficiency of drawing in ink.

Note that the angle parts 6C of the first main groove 66A and the angle parts 6C of the second main groove 67A are made to show an angle that is suitable for conveniently releasing the mold from the spacer portion 6.

The liquid container 1 can be manufactured by way of the manufacturing process that will be described below. First, the holding member 4 is integrally formed by way of the above-described process. Then, the holding member 4 is fitted to the connection member 8 as indicated by way of the process step P1 shown in FIG. 2B and FIG. 3B. Thereafter, the second end 52 of the first tube 5A and also the second end 52 of the second tube 5B are fitted to the connection member 8 as indicated by the process step P2 shown in FIG. 3B and FIG. 4B. Subsequently, the first tube 5A is fitted into the first main groove 66A of the spacer portion 6 at the first end 51 thereof and the second tube 5B is fitted into the second main groove 67A of the spacer portion 6 also at the first end 51 thereof as indicated by process step P3 in FIG. 3B and FIG. 4B. While it is preferable that the process step P2 is executed first and the process step P3 is executed thereafter from the viewpoint of causing the holding member 4 to reliably and securely hold the first and second tubes 5A and 5B, the process step P3 may alternatively be executed before the execution of the process step P2. Then, the connection member 8 is fitted to the retaining member 9 as indicated by the process step P4 in FIG. 2B and FIG. 3B. Now, the operation of assembling the holding member 4, the connection member 8, the first and second tubes 5A and 5B, which are held by the holding member 4 and the connection member 8, and the retaining member 9 is completed. Thereafter, the holding member 4 and the first and second tubes 5A and 5B are arranged in the inner space 31 of the liquid container bag 3 such that both the first end 51 of the first tube 5A and the first end 51 of the second tube 5B are held open in the inner space 31 of the liquid container bag 3 as indicated by the process step P5 in FIG. 2B. Subsequently, the aperture 34 of the liquid container bag 3 that is fitted to the outer surface of the connection member 8 is hermetically sealed. The manufacturing of the liquid container 1 is completed as a result of the above-described process steps. When mounting the liquid container 1 in the liquid ejection apparatus 100, the liquid container 1 is put into the cassette 2 as indicated by the process step P6 in FIG. 2B. Then, the cassette 2 now bearing the liquid container 1 is driven to slide into the liquid ejection apparatus 100 in the X-direction to complete the operation of mounting the cassette 2 into the liquid ejection apparatus 100.

The holding member of a liquid container according to the present disclosure is realized by modifying the known structure of the part of the holding member where the tubes are fitted to the holding member so as to allow the holding member to be integrally molded. Thus, the present disclosure provides a liquid container including a holding member showing an improved ink supply performance. The present disclosure also provides a method of manufacturing a holding member to be used in a liquid container that allows the holding member to be molded by integral molding.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. A liquid container comprising:

a liquid container bag configured to contain liquid to be used in a liquid ejection apparatus;

a connection member arranged at an opening part of the liquid container bag, the opening part being located at an end of the liquid container bag;

a linker member which is connected to the connection member and extends to a middle of the inside of the liquid container bag;

a spacer portion connected to the linker member; and a tube fitted to the connection member and to the spacer portion so as to draw out liquid from the liquid container bag;

the spacer portion having a main groove provided as a recess running along the extending direction of the linker member and an auxiliary groove running along the direction intersecting the extending direction of the main groove, the tube being fitted into the main groove such that an end of the tube is located at a midway of the main groove.

2. The liquid container according to claim 1, wherein the spacer portion has a diamond shape when viewed as a cross-section that is perpendicular to the extending direction of the main groove, and the main groove includes first and second main grooves provided at an upper vertex region and at a lower vertex region of the diamond shape, respectively, in a state where the liquid container is mounted in the liquid ejection apparatus, each main groove being provided as a recess running from an end connected to the connection member to the other end, and the auxiliary groove includes a plurality of auxiliary grooves which are provided relative to each of the first and second grooves, each auxiliary groove being provided as a recess open to a side surface of the spacer portion.

3. The liquid container according to claim 2, wherein the tube includes a first tube to be fitted into the first main groove and a second tube to be fitted into the second main groove.

4. The liquid container according to claim 3, wherein each of the first and second tubes are connected to the connection member.

5. The liquid container according to claim 1, wherein the linker member and the spacer portion are integrally formed.

6. The liquid container according to claim 1, wherein the liquid container bag has flexibility and the spacer portion is interposed between an upper surface and a lower surface of the liquid container bag in a state where the liquid container is mounted in the liquid ejection apparatus.

7. The liquid container according to claim 1, wherein the end of the tube is located such that the tube is fitted into the main groove by a length that is greater than or equal to the outer diameter of the tube.

* * * * *